United States Patent [19]

Daly

[11] 4,295,647

[45] Oct. 20, 1981

[54] GAME AND ARTICLE FOR USE THEREWITH

[76] Inventor: James E. Daly, 321 A. Howell Rd., Malvern, Pa. 19355

[21] Appl. No.: 131,231

[22] Filed: Mar. 17, 1980

[51] Int. Cl.[3] ..... A63B 67/00

[52] U.S. Cl. ..... 273/1 G; 2/239

[58] Field of Search ..... 273/1 R, 1 G; 2/239, 2/241, 61, 18, 267; 128/157, 165

[56] References Cited

U.S. PATENT DOCUMENTS

| | | | |
|---|---|---|---|
| 832,550 | 10/1906 | Lepper | 2/239 X |
| 1,744,122 | 1/1930 | Keeling | 128/157 X |
| 3,023,420 | 3/1962 | Tann | 2/239 |

*Primary Examiner*—Paul E. Shapiro

*Attorney, Agent, or Firm*—Herbert E. Haynes, Jr.

[57] ABSTRACT

An amusement article used in playing a game includes a sock having a padded tubular enlargement extending beyond the toe thereof. Each player of the game wears at least one of the special socks and the object is to effect extraction of the oppenent's sock by stepping on the padded tubular enlargement.

1 Claim, 3 Drawing Figures

GAME AND ARTICLE FOR USE THEREWITH

BACKGROUND OF THE INVENTION

1. Field of the Invention

This invention relates to games and apparatus for use therewith and more particularly to an especially constructed sock for use in playing parlor games.

2. Description of the Prior Art

Many parlor type games have been developed over the years for amusing both children and adults at parties and at other times of recreation. Such parlor games usually fall into one of two basic classes, namely, those involving "Monopoly" type games where the participants are mentally, rather than physically involved, with the other class being, of course, games which require physical involvement. Each basic class of parlor games has its place, and the game and apparatus of the present invention is of the second class in that it is physical in nature.

Parlor games of the physical involvement type sometimes utilize equipment normally found around a home such as a tub for use in playing the well known apple bobbing game. Others involve special equipment which can be expensive to purchase and, in some instances is cumbersome to handle and awkward to store during nonuse periods.

To the best of my knowledge, the prior art game and device for use therewith most closely related to the present invention is that disclosed fully in U.S. Pat. No. 3,501,144. In this Patent an especially constructed toe toy is disclosed for mounting on the shoes of the game participants so that the toy extends beyond the toes of the shoes. The toe toy includes a molded pocket containing a noise maker, and the object of the game is for the participants to step on their opponent's toe toy to squeezingly actuate the noise maker. This game and the special apparatus required, have several drawbacks. First, the especially constructed toe toy is inherently a relatively expensive structure and secondly, any game involving the use of feet is better played without shoes in that sore feet and bruised ankles and shins can result from over zealous participants. Thirdly, and probably the most serious drawback of this prior art game, is that the relatively simple act of stepping on the opponent's toe toy is all that is required to end the game, and since no continuing or further challenge is involved the participants will quickly tire of the game.

Accordingly, the present invention discloses an especially constructed sock, or stocking, having the usual open top tubular structure for loosely encasing a wearer's foot and ankle and extending at least part way up the wearer's leg. A tubular enlargement is mounted on or formed integrally with the toe enclosing portion of the special sock so as to extend therebeyond, and the tubular enlargement is filled with a suitable padding material such as cloth, sponge rubber and the like.

In playing the game, the participants, which may number two or more, are each provided with at least one of the above described special socks and the object is to step on the enlarged padded extension of the opponent's socks so as to remove them from the opponent's feet. The winner may be determined by the player who keeps his sock the longest, or alternately, by the player who removes and captures the largest number of socks.

It is therefore, an object of the present invention to provide a new and improved game and article for use therewith.

Another object of the present invention is to provide a new and improved article which is inexpensive to manufacture and simple to use in the playing of a game.

Another object of the present invention is to provide a new and improved article for use in a parlor type game with the article including a sock having a tubular enlargement extending from the toe enclosing portion of the sock, with the tubular enlargement being filled with a padding material.

Another object of the present invention is to provide an article of the above described character for use in playing of a game wherein each player wears at least one of the special socks and attempts to step on the padded toe extension of the opponent's sock in a manner so as to remove it from the opponent's foot.

The foregoing and other objects of the present invention, as well as the invention itself, may be more fully understood from the following description when read in conjunction with the accompanying drawing.

DESCRIPTION OF THE PREFERRED EMBODIMENT

Figure 1:
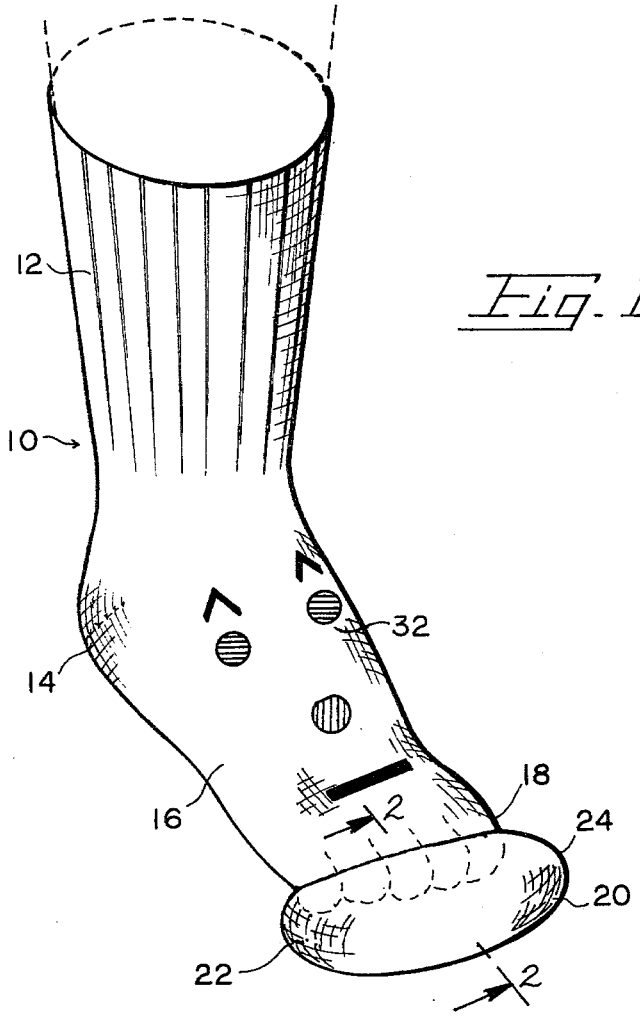
FIG. 1 is a perspective view of the amusement article of the present invention and illustrates the various features thereof.

Referring more particularly to the drawing, FIG. 1 shows the apparatus of the present invention as being an especially configured sock, or stocking, which is indicated generally by the reference numeral 10. The sock 10 is of the conventional open top tubular configuration including an ankle and leg encasing portion 12, a heel 14, a foot encasing portion 16 which is closed by a toe enclosing portion 18.

Figure 2:
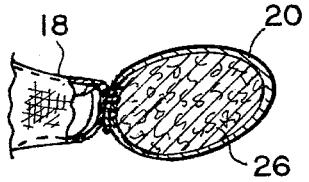
FIG. 2 is an enlarged fragmentary sectional view taken on the line 2—2 of FIG. 1.

The sock 10, which may be knitted or otherwise formed of conventional textile material, is provided with a transverse enlargement 20 which extends beyond the toe enclosing portion 18 of the sock and may extend laterally beyond the opposite ends of the toe enclosing portion 18. The transverse enlargement 20 is a tubular structure of textile materials with its opposite ends closed as at 22 and 24, and is of generally cylindrical or elliptical cross section. The tubular enlargement may be sewn to the toe enclosing portion 18 of the sock 10 as shown best in FIG. 2, or alternately, it may be formed as an integral part thereof during manufacture of the sock. A suitable padding material 26, such as foam rubber, cotton or other soft material is contained within the tubular enlargement 20 as seen in FIG. 2.

Figure 3:
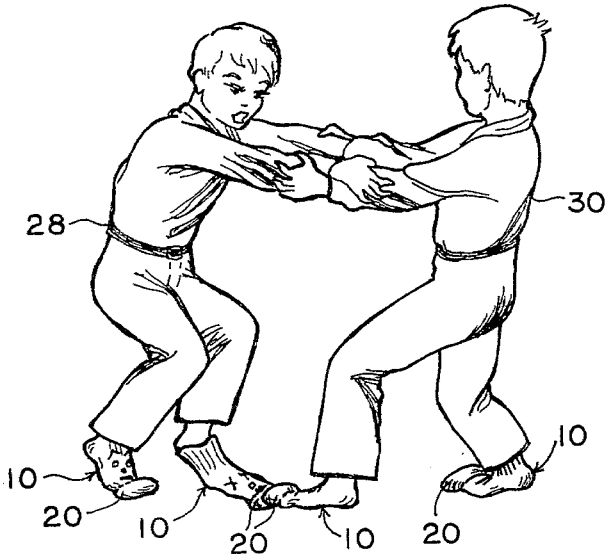
FIG. 3 is an illustration showing two game participants wearing the amusement article of the present invention and illustrating one way of playing a game therewith.

As shown in FIG. 3, a pair of the above described special socks 10 are worn in the normal manner by two people 28 and 30 who are participant's in a game played by the following, or similar rules, The players 28 and 30 face each other and grasp their opponent's forearms in the manner shown. The players then attempt to step on the padded tubular enlargement 20 of the opponent's socks 10 in a manner which pins the socks to the floor so that subsequent movements of either of the players will cause extraction of the foot from the pinned sock. The player who first succeeds in removing both of the opponent's socks is the winner.

It will be appreciated that the hereinbefore described rules for playing the game are only suggestive in nature in that many variations are possible. For example, the two players 28 and 30 could be provided with one of the special socks 10 rather than the pair shown in FIG. 3, and/or one arm of each player could be placed behind his back. Further, several pairs of variously colored socks can be provided to several players (not shown) and these several players can simultaneously play a game similar to that described above, with the winner being the last player to retain his sock or socks, or the player extracting the largest number of his opponents' socks.

The special sock 10 of the present invention may be provided with special indicia 32 thereon such as the caricaturized facial representation shown best in FIG. 1.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environment and operation requirements without departing from those principles. The appended claims are therefore intended to cover and embrace any such modifications within the limits only of the true spirit and and scope of the invention.

What I claim is:

1. An amusement article comprising:

(a) an open top sock having an ankle encasing portion, and a toe enclosing portion; and (b) a padded enlargement at the toe enclosing portion of said sock, said padded enlargement including, I. a tubular structure of textile material having its opposite ends closed, said tubular structure disposed transversely of said open top sock and disposed so as to protrude beyond the toe enclosing portion thereof, and II. a soft padding material in said tubular structure.

* * * * *